United States Patent [19]

Nester

[11] 3,990,115

[45] Nov. 9, 1976

[54] ROLL TOP CUFFLESS SOCK AND METHOD OF FORMING SAME

[75] Inventor: Dallas G. Nester, Mount Airy, N.C.

[73] Assignee: Renfro Corporation, Mount Airy, N.C.

[22] Filed: Jan. 22, 1976

[21] Appl. No.: 651,461

[52] U.S. Cl. ..... 2/239; 66/171; 66/172 E

[51] Int. Cl.[2] ..... A41B 11/00

[58] Field of Search ..... 2/239, 240, 61; 36/10; 66/171, 172 E, 172 R

[56] References Cited

UNITED STATES PATENTS

| | | | |
|---|---|---|---|
| 2,904,980 | 9/1959 | Stinson | 2/239 X |
| 3,130,566 | 4/1964 | Chesebro | 2/239 X |
| 3,274,804 | 9/1966 | Thorneburg et al. | 66/172 E |

*Primary Examiner*—H. Hampton Hunter
*Attorney, Agent, or Firm*—Bell, Seltzer, Park & Gibson

[57] ABSTRACT

A cuffless sock is provided which has a permanently rolled top portion adapted to encircle the lower ankle area of the wearer and which is knitted in such a way that the rolled top portion has an inherent tendency to roll upon itself. The rolled top portion is tacked to the body portion of the sock at spaced apart points at the sides of the foot receiving opening to hold the top portion in its rolled condition while permitting the untacked front and rear portions of the top to conform to varying configurations and heights of the upper edge of different shoes with which the sock is to be worn. The front and rear portions of the rolled top are preferably provided with terry loops while the opposite side portions are devoid of terry loops to be substantially smaller than the front and rear rolled top portions.

12 Claims, 7 Drawing Figures

ROLL TOP CUFFLESS SOCK AND METHOD OF FORMING SAME

This invention relates generally to a cuffless sock including a permanently rolled top portion adapted to encircle the lower ankle area of the wearer and more particularly to such a sock and method of forming the same wherein opposite side edges of the rolled top portion of the sock are tacked to prevent unrolling of these side edges and to also aid in maintaining the remaining untacked front and rear portions of the rolled top in rolled condition to prevent the upper edge portion of the sock from sliding down into the shoe while accommodating the different configurations and heights of the upper edge of various shoes.

Several different types of cuffless socks have been proposed for wear inside of a shoe and to be substantially covered thereby. One such sock requires that a portion of the ankle material be cut or trimmed to form the foot receiving opening and then the cut edge is bound to prevent ravelling while an elastic band is secured to the opening to permit stretchability and to aid in preventing the upper edge of the sock from sliding down into the shoe. Other types of cuffless socks have been formed with various types of support tabs or flaps which fold down over the top of the heel of the shoe and are provided to prevent the sock from slipping down into the shoe. However, the known types of cuffless socks require either an expensive cutting and sewing operation or special knitting techniques, and none includes a permanently rolled top portion which will prevent the socks from slipping down into the shoe while also accommodating the different configurations and heights of the upper edge thereof.

With the foregoing in mind, it is an object of the present invention to provide a cuffless sock with an attractive permanently rolled top which may be economically knit on a circular hosiery knitting machine and requires only the tacking of opposite side edges of the roll top portion to complete the sock. The untacked front and rear portions of the rolled top may roll and unroll to the degree required to accommodate the configuration of the upper edge of the shoe and to permit the sock to be worn with shoes of different styles.

In accordance with the present invention, the rolled top portion of the cuffless sock is completed on the knitting machine, except for tacking down opposite side edge portions to thereby eliminate any cutting and binding of the edge portion of the sock. The tacked opposite side portions maintain these portions in contact with the body of the sock while permitting some unrolling of the untacked front and rear portions to accommodate shoes having different upper edge configurations and/or heights.

The rolled top portion of the cuffless sock of the present invention is formed of a plurality of complete courses knit with continued rotation of the needle cylinder and elastic yarn is incorporated in each of the complete courses of the rolled top portion with a greater number of strands of elastic yarn being incorporated in the initial complete course of the top portion. The additional strands of elastic yarn in the initial course aid in causing the rolled top portion to roll outwardly upon itself and aid in maintaining the front and rear portions of the top portion in rolled condition when worn.

At least the portion of the rolled top extending around and above the heel includes terry loops extending outwardly therefrom so that this portion is larger than the opposite side edge portions which are tacked together. The opposite side edge portions of the rolled top portion do not include terry loops so that these side edge portions are of a smaller diameter than the rolled top portion extending around the rear and above the heel. This untacked rear rolled top portion aids in preventing the rear portion of the sock from sliding down into the shoe while some unrolling is permitted so that the sock may be worn with shoes of different heights.

Other objects and advantages will appear as the description proceeds when taken in connection with the accompanying drawings, in which FIG. 1 is a perspective view of the cuffless sock with the rolled top portion in unrolled condition;

Figure 1:
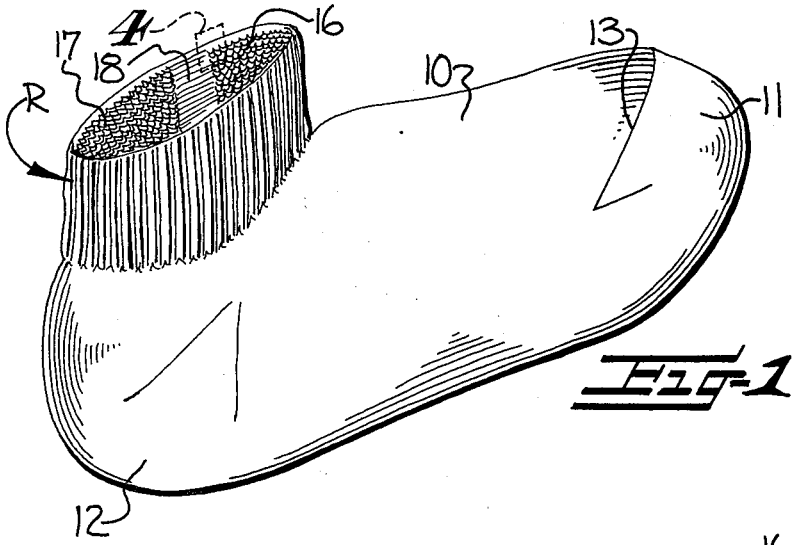

The cuffless sock includes a foot portion 10 having a toe portion 11 and a heel embracing portion 12. The toe portion 11 may be closed by any suitable means such as a seam line 13, and the toe 11 and heel 12 may be formed by one of any of the conventional methods. A top portion, broadly indicated at R, is integrally knit with the remainder of the sock and is positioned above and closely adjacent the heel embracing portion 12 so that is encircles the lower ankle area of the wearer. The top portion R defines the opening adapted to receive the foot of the wearer therethrough and tacking, such as stitching illustrated, in the form of bar tacking 15, penetrates the rolled top portion at opposite side edges only of the foot receiving opening to prevent unrolling of these opposite side edge portions. The tacking 15 also aids in maintaining the remaining unstitched front and rear portions 16, 17 of the rolled top portion in rolled condition while not restricting the stretchability of the foot receiving opening.

The front and rear portions 16, 17 of the rolled top R include terry loops T extending outwardly therefrom while the opposite side edge portions 18 are devoid of terry loops. Thus, the diameter of the front and rear rolled portions 16, 17 is substantially greater than the diameter of the opposite side edge portions 18.

Figure 4:
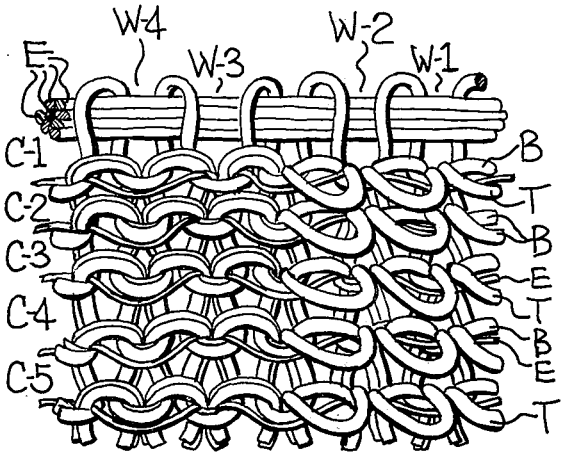
FIG. 4 is a greatly enlarged fragmentary view of the portion of the rolled top portion enclosed in the dotted line rectangle 4 in FIG. 1 and illustrating the manner in which terry loops are formed in the knit fabric in areas of the rolled top and plain stitches with inlaid elastic yarn are formed in the side edge portion.
Figure 5:
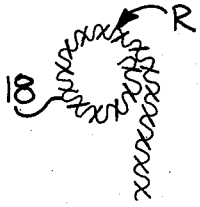
FIG. 5 is an enlarged vertical sectional view taken substantially along the line 5—5 in FIG. 3.
Figure 3:
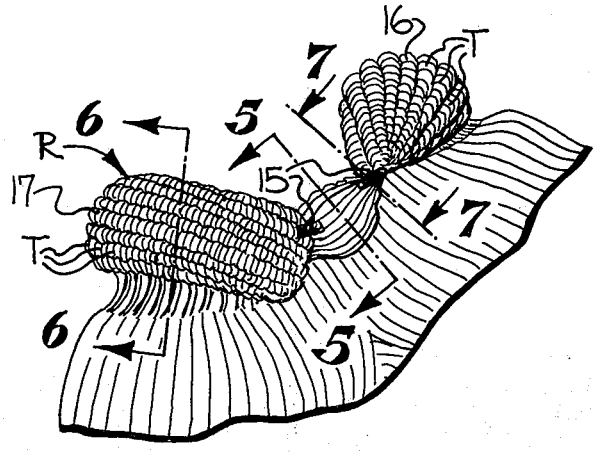
FIG. 3 is a fragmentary elevational view of one side of the rolled top portion, illustrating the relative sizes of the front and rear portions and the opposite side edges and showing the tacking penetrating the side edge portion.
Figure 6:
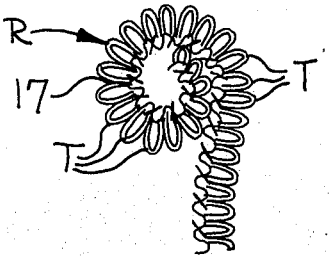
FIG. 6 is an enlarged vertical sectional view taken substantially along the line 6—6 in FIG. 3.

As best shown in FIG. 1, the top portion R contains a given number of complete courses, portions of which are indicated at C-1 through C-5 in FIG. 4. Each of these complete courses includes a single strand or round of elastic yarn, indicated at E, incorporated therein by inlaying in what is known as a 1 × 1 manner to form a mock rib appearance, as indicated at FIG. 1. As shown in FIG. 4, the initial or make-up course C-1 of the top portion R includes eight strands or rounds of elastic yarn E so that this initial course has eight times as much elastic yarn incorporated therein as is incorporated in the remaining complete courses of the roll top portion. This additional elastic yarn in the initial course aids in causing the top portion to automatically roll outwardly upon itself and also aids in preventing the unrolling of the unstitched front and rear portions 16, 17 of the top portion R. However, the untacked front and rear portions 16, 17 can roll and unroll to the degree required to accommodate the configuration of the upper edge of the shoe.

The relatively large rear portion 17 of the top portion R preferably encompasses substantially one-half of the wales in the complete courses forming the top portion. The opposite side edge portions 18, which are devoid of terry loops, each encompass one-eighth of the wales in the complete courses forming the top portion R. The relatively large front portion 16 of the top portion R encompasses substantially one-fourth of the wales in the complete courses forming the top portion R.

It is to be understood that the permanently rolled top portion R will not normally stand straight up, as shown in FIG. 1, since the rounds of elastic yarn E in the initial course C-1 and in the remaining course contract the top portion and causes this portion to curl and roll outwardly upon itself. As illustrated in FIG. 4, the terry loops T in the front portion 16 are formed in the sinker wales between needle wales W-1, w-2, and w-2, W-3 while no terry loops are formed in the adjacent side edge portion 18 but the terry loop yarn is knit in plated relationship with the body yarn in these areas and in a manner to be presently described.

METHOD OF KNITTING

The cuffless sock of the present invention will be described as being knit on a 108 needle circular hosiery knitting machine. However, it is to be understood that the cuffless sock could be knit on other types of knitting machines. To form the initial course C-1 or make-up, the elastic yarn E is fed to every other needle while it is floated inside of the remaining needles during eight rotations of the needle cylinder. The body yarn, indicated at B, is then fed to and forms stitch loops on every needle so that adjacent stitch loops are formed in course C-1 and on opposite sides of the inlaid elastic yarns E, as illustrated in FIG. 4. During the next rotation of the needle cylinder, the terry yarn T and body yarn B are fed to all of the needles while the elastic yarn E is still fed to the hook side of every other needle.

The sinkers corresponding to the side of the cylinder which knits the heel embracing portion 12 are advanced earlier than normal so that the terry loop yarn T is drawn down over the nebs thereof while the body yarn B is fed below and drawn down over the normal throat portion of the sinkers to thereby form the terry loops in the sinker wales of the rear portion 17 of the top portion R. The terry loops are formed in 54 sinker wales at the rear of the rolled top portion R. In the opposite side edge portions 18, the sinkers are advanced in the normal manner so that both the terry yarn T and the body yarn B are drawn down over the normal stitch forming throats and no terry loops are formed in these portions. It is preferred that the opposite side edge portions 18, which are devoid of terry loops, each encompass 12 sinker wales.

The sinkers which are used to knit the front portion 16 are also advanced at an earlier than normal position so that the terry yarn T is drawn down over the nebs while the body yarn B is drawn down over the normal stitch forming throat and terry loops are formed in 28 sinker wales in the front portion 16. 24 complete courses are knit in this manner to complete the top portion R and, as has been pointed out, the fabric in this roll top area provides a mock rib appearance, because of the manner in which the elastic yarn E is inlaid in each course. After these complete courses have been knit to complete the knitting of the top portion R, the elastic yarn E is removed and eight plain courses with terry loops formed in each sinker wale are formed before the heel embracing portion 12 is knit.

The heel embracing portion 12 is illustrated as being formed by reciprocation of the needle cylinder and with fashioned gussets, however, the heel embracing portion 12 may be formed by any one of several well-known methods. The heel embracing portion 12 also preferably includes inwardly extending terry loops formed therein. The foot portion 10 is knit with continuous rotation of the needle cylinder and terry loops also are preferably formed therein. The toe portion 11 is illustrated as being formed by reciprocation of the needle cylinder with fashioned gussets and the toe portion also includes terry loops formed on the inner surface thereof.

Figure 7:
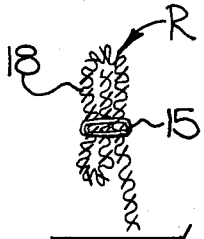
FIG. 7 is an enlarged vertical sectional view taken substantially along the line 7—7 in FIG. 3.
Figure 2:
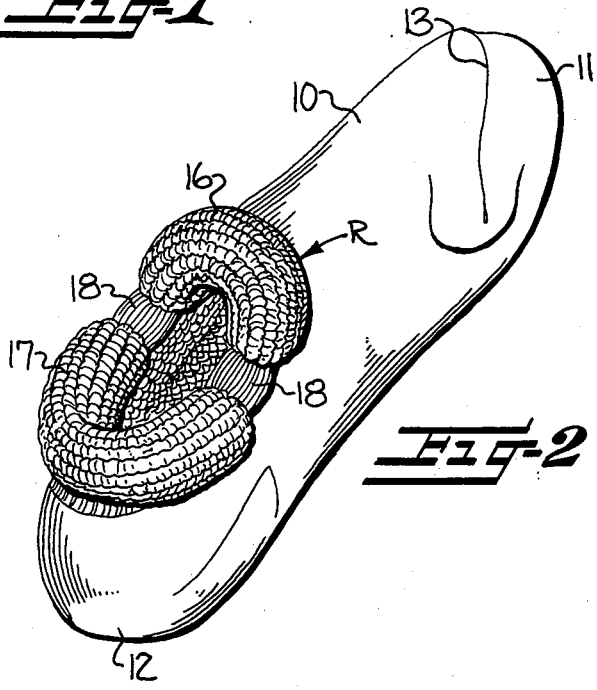
FIG. 2 is a perspective view of the cuffless sock with the top portion rolled outwardly upon itself and with opposite side edges being stitched together.

Upon completion of the knitting of the sock blank on the knitting machine, the toe portion 11 is closed, as by looping or stitching along the line 13. The opposite side edge portions 18 are tacked as by stitching 15, in the form of bar tacking, which penetrates the rolled top portion R and the inner surface of the sock (FIG. 7) to prevent unrolling of these opposite side edge portions 18 of the rolled top portion R. The stitching 15 also aids in maintaining the remaining unstitched front and rear portions 16, 17 in rolled condition while it does not restrict the stretchability of the remaining portion of the foot receiving opening. Any suitable type of tacking may be utilized in the opposite side edge portions 18 and it is preferred that a bar tack or buttonhole type stitch be used to hold these opposite side edge portions 18 in rolled condition.

Although the cuffles sock is illustrated as including terry loops in both the front and rear portions 16, 17, it is to be understood that the terry loops in the front portion 16 may be omitted and the smaller rolled portions 18 at opposite sides can be continued around the front portion of the rolled top portion R. A very attractive cuffless sock is formed if the rolled top portion R, including both body and terry yarns, is knit of a different color yarn than the foot portion.

In the drawings and specification there has been set forth a preferred embodiment of the invention, and although specific terms are employed, they are used in a generic and descriptive sense only and not for purposes of limitation, the scope of the invention being defined in the claims.

That which is claimed is:

1. A knit cuffless sock comprising a foot portion including a toe portion and a heel embracing portion, and a rolled top portion positioned above and closely adjacent said heel embracing portion and adapted to encircle the lower ankle area of the wearer, said rolled top portion comprising a plurality of complete courses and having the inherent tendency to roll, and being rolled, outwardly upon itself to define an opening adapted to receive the foot of the wearer therethrough, and tacking means securing said rolled top portion to said foot portion at opposite side edges of the foot receiving opening to substantially permanently maintain said top portion in rolled condition while permitting some unrolling of the front and rear portions of the rolled portion to accommodate different upper configurations and heights of shoes of different styles.

2. A knit cuffless sock according to claim 1 including elastic yarn incorporated in each of said complete courses of said rolled top portion to contract said top portion when in relaxed condition and to aid in maintaining the portions of said top portion forwardly and rearwardly of said tacking means in rolled condition and to cause said top portion to grip the lower ankle area of the wearer.

3. A knit cuffless sock according to claim 1 wherein the portion of said rolled top portion positioned rearwardly of said tacking means includes terry loops extending outwardly therefrom, and wherein said opposite side edge portions immediately adjacent said rear portion of said top portion is devoid of terry loops so that the diameter of said rear portion is substantially greater than the adjacent opposite side edge portions which are penetrated by said tacking means.

4. A knit cuffless sock according to claim 2 wherein the initial course of said complete courses forming said rolled top portion includes approximately eight times as much elastic yarn incorporated therein as is incorporated in the remaining complete courses of said top portion, sid additional elastic yarns in said initial complete course aiding in maintaining the unstitched front and rear portions of said top portion in rolled condition.

5. A knit cuffless sock according to claim 3 wherein said portion of said rolled top portion positioned forwardly of said tacking means also includes terry loops extending outwardly therefrom so that the diameter of both said front and rear portions of said top portions and substantially greater than said opposite side edge portions.

6. A knit cuffless sock according to claim 3 wherein said relatively large rear portion of said rolled top portion encompasses substantially one-half of the wales of the complete courses forming said top portion.

7. A knit cuffless sock according to claim 6 wherein said opposite side edge portions of said rolled top portion which are devoid of terry stitch loops each comprise approximately one-eighth of the wales of said complete courses forming said top portion.

8. A knit cuffless sock comprising a foot portion including a toe portion and a heel embracing portion, and a rolled top portion positioned above and closely adjacent said heel embracing portion and adapted to encircle the lower ankle area of the wearer, said roll top portion comprising a plurality of complete courses and having the inherent tendency to roll, and being rolled, outwardly upon itself to define an opening adapted to receive the foot of the wearer therethrough, elastic yarn incorporated in each of said complete courses of said roll top portion to contract said top portion when in relaxed condition and to aid in maintaining said top portion in rolled condition and to cause said top portion to grip the lower ankle area of the wearer, tacking means securing said rolled top portion to said foot portion at opposite side edges of the foot receiving opening to substantially permanently maintain said top portion in rolled condition while permitting some unrolling of the front and rear portions of the rolled top portion to accommodate different upper configurations and heights of shoes of different styles, terry loops extending outwardly from the portion of said rolled top portion positioned rearwardly of said tacking means, and said opposite side edge portions immediately adjacent said rear portion of said top portion being devoid of terry loops so that the diameter of said rear portion is substantially greater than the adjacent opposite side edge portions which are penetrated by said tacking means.

9. A method of forming a cuffless sock including a foot portion with a toe portion and a heel embracing portion and a rolled top portion positioned above and closely adjacent the heel embracing portion and adapted to encircle the lower ankle area of the wearer, said method comprising the steps of knitting a plurality of complete courses to form said top portion, knitting the heel embracing portion, the foot portion and the toe portion, closing the toe portion, and tacking opposite side edge portions only of said top portion while in rolled condition to maintain said side edge portions in contact with the body of the sock and to substantially permanently maintain said top portion in rolled condition while permitting some unrolling of the front and rear portions of the rolled top portion to accommodate different upper configurations and heights of shoes of different styles.

10. A method according to claim 9 including the step of incorporating elastic yarn in said plurality of complete courses to aid in maintaining the portions of said top portion forwardly and rearwardly of said tacking in rolled condition and to cause said top portion to grip the lower ankle of the wearer.

11. A method according to claim 9 including the step of forming terry loops in that portion of said rolled top portion positioned rearwardly of said tacking so that the rear portion is substantially greater in diameter than the adjacent side edge portions which are penetrated by said tacking.

12. A method according to claim 11 including the step of forming terry loops in that portion of said rolled top portion positioned forwardly of said tacking so that the diameter of both said front and rear portions of said top portion are substantially greater than said tacked opposite side edge portions.

* * * * *

UNITED STATES PATENT OFFICE

CERTIFICATE OF CORRECTION

Patent No. 3,990,115 Dated November 9, 1976

Inventor(s) Dallas G. Nester

It is certified that error appears in the above-identified patent and that said Letters Patent are hereby corrected as shown below:

Column 3, line 25, "course", second occurrence, should read -- courses --; line 26, "causes" should read -- cause --; line 29, "w-2" should read -- W-2 --. Column 4, line 43, "cuffles" should read -- cuffless --. Column 5, line 5, after "rolled" insert -- top --; line 29, "sid" should read -- said --; line 37, "portions", second occurrence, should read -- portion --; line 38, "and" should read -- are --.

Signed and Sealed this

Eleventh Day of January 1977

[SEAL]

*Attest:*

RUTH C. MASON
*Attesting Officer*

C. MARSHALL DANN
*Commissioner of Patents and Trademarks*